US008381553B2

(12) United States Patent
Park et al.

(10) Patent No.: US 8,381,553 B2
(45) **Date of Patent: *Feb. 26, 2013**

(54) WASHING MACHINE

(75) Inventors: Hye Yong Park, Changwon-si (KR); Bo Yeon Kim, Changwon-si (KR); Dae Hee Kwon, Busan-si (KR); Hyun Seok Kim, Seoul (KR); Seong Yeol Lee, Daegu-si (KR)

(73) Assignee: LG Electronics Inc., Seoul (KR)

( * ) Notice: Subject to any disclaimer, the term of this patent is extended or adjusted under 35 U.S.C. 154(b) by 1480 days.

This patent is subject to a terminal disclaimer.

(21) Appl. No.: 11/404,116

(22) Filed: Apr. 14, 2006

(65) Prior Publication Data

US 2006/0254320 A1 Nov. 16, 2006

(30) Foreign Application Priority Data

Apr. 15, 2005 (KR) ..... 10-2005-0031478

(51) Int. Cl.
*D06F 39/14* (2006.01)
*D06F 37/10* (2006.01)

(52) U.S. Cl. ..... 68/196; 68/3 R; 68/139

(58) Field of Classification Search ..... 68/196
See application file for complete search history.

(56) References Cited

U.S. PATENT DOCUMENTS

2004/0134239 A1* 7/2004 Hapke et al. ..... 68/12.26
2006/0059710 A1* 3/2006 Kim ..... 34/603

FOREIGN PATENT DOCUMENTS

| | | | |
|---|---|---|---|
| DE | 69719679 | | 12/2003 |
| EP | 0588100 | * | 3/1994 |
| JP | 2005-65909 A | * | 3/2005 |
| JP | 2005065909 | | 3/2005 |
| JP | 2005065909 A | * | 3/2005 |
| KR | 1020040011218 | * | 2/2004 |

OTHER PUBLICATIONS

English machine translation ofJP2005-65909A to Kajiwara et al.*

* cited by examiner

*Primary Examiner* — Michael Barr
*Assistant Examiner* — Jason Riggleman
(74) *Attorney, Agent, or Firm* — McKenna Long & Aldridge LLP

(57) ABSTRACT

A washing machine is provided for washing laundry therein. The washing machine includes a hinge member including a door coupling portion and at least one coupling section having at least one hinge coupling hole corresponding to a cabinet coupling hole. The washing machine further includes a front cabinet cover and a rear cabinet cover, having at least one cabinet coupling hole in which at least one coupling member is tightend. The hinge member is directly couple to the rear cabinet cover.

14 Claims, 8 Drawing Sheets

WASHING MACHINE

This application claims the benefit of Korean Patent Application No. 10-2005-31478, filed on Apr. 15, 2005, which is hereby incorporated by reference for all purposes as if fully set forth herein.

BACKGROUND OF THE INVENTION

1. Field of the Invention

The present invention relates to a washing machine.

2. Description of the Related Art

Generally, washing machines include a drum in which laundries such as garments, linens, and fabrics (hereinafter, referred to collectively as fabrics) are washed by water and detergent (hereinafter, referred to as wash water) fed into a tub in washing mode. Then, the garments are rinsed and excess water is extracted from the garments in rinsing and spinning modes.

During use or transportation of the washing machine, a cabinet cover of the washing machine can be scratched or deformed, causing degradation in appearance. Further, users may be surfeited with the frontal appearance of the washing machine after long use of the washing machine. In addition, since the cabinet cover is coated with a coating material, the manufacturing process of the cabinet is complicated and manufacturing costs increases.

To eliminate such disadvantages, the cabinet cover can be constructed using a non-coated rear cabinet cover and an exchangeable plastic front cabinet cover attached to a front side of the rear cabinet cover. In this case, the frontal appearance of the washing machine can be improved and the manufacturing costs can be reduced. However, hot/cold durability test results show that the plastic front cabinet cover can be partially deformed. In detail, when a hinge member is attached to the front cabinet cover using a coupling member, a gap can develop between the hinge member and the front cabinet cover due to the deformation of the front cabinet cover, which increases vibration and noise during the operation of the washing machine.

SUMMARY OF THE INVENTION

Accordingly, the present invention is directed to a washing machine that substantially obviates one or more problems due to limitations and disadvantages of the related art.

An object of the present invention is to provide a washing machine that has an improved hinge member for a door such that vibration and noise caused by deformation of the hinge member can be prevented.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine including: a door; a front cabinet cover forming a front part of the washing machine together with the door; a rear cabinet cover disposed at a rear side of the front cabinet cover; and a hinge member connecting the door and the rear cabinet cover for allowing rotation of the door.

In another aspect of the present invention, there is provided a washing machine including: a door; a front cabinet cover and a rear cabinet cover that are disposed in a front-to-rear direction and include fabric openings, respectively, the fabric openings being closed and opened by the door; and a hinge member including a door coupling portion coupled to the door, a rear cabinet cover coupling portion coupled to the rear cabinet cover, and a hinge connection portion connecting the door coupling portion and the rear cabinet cover coupling portion.

In a further another aspect of the present invention, there is provided a washing machine including: a door; a hinge member having one side coupled to the door; a rear cabinet cover coupled to the other side of the hinge member; and a front cabinet cover including a hole through which a section of the hinge member is inserted.

According to the washing machine of the present invention, since the hinge member to which the door is fixed is directly coupled to the rear cabinet cover instead of the front rear cabinet cover, the coupling between the hinge member and the rear cabinet cover can be stably maintained even when the front cabinet cover is deformed. Therefore, even when the front cabinet cover is deformed, vibration and noise are not generated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
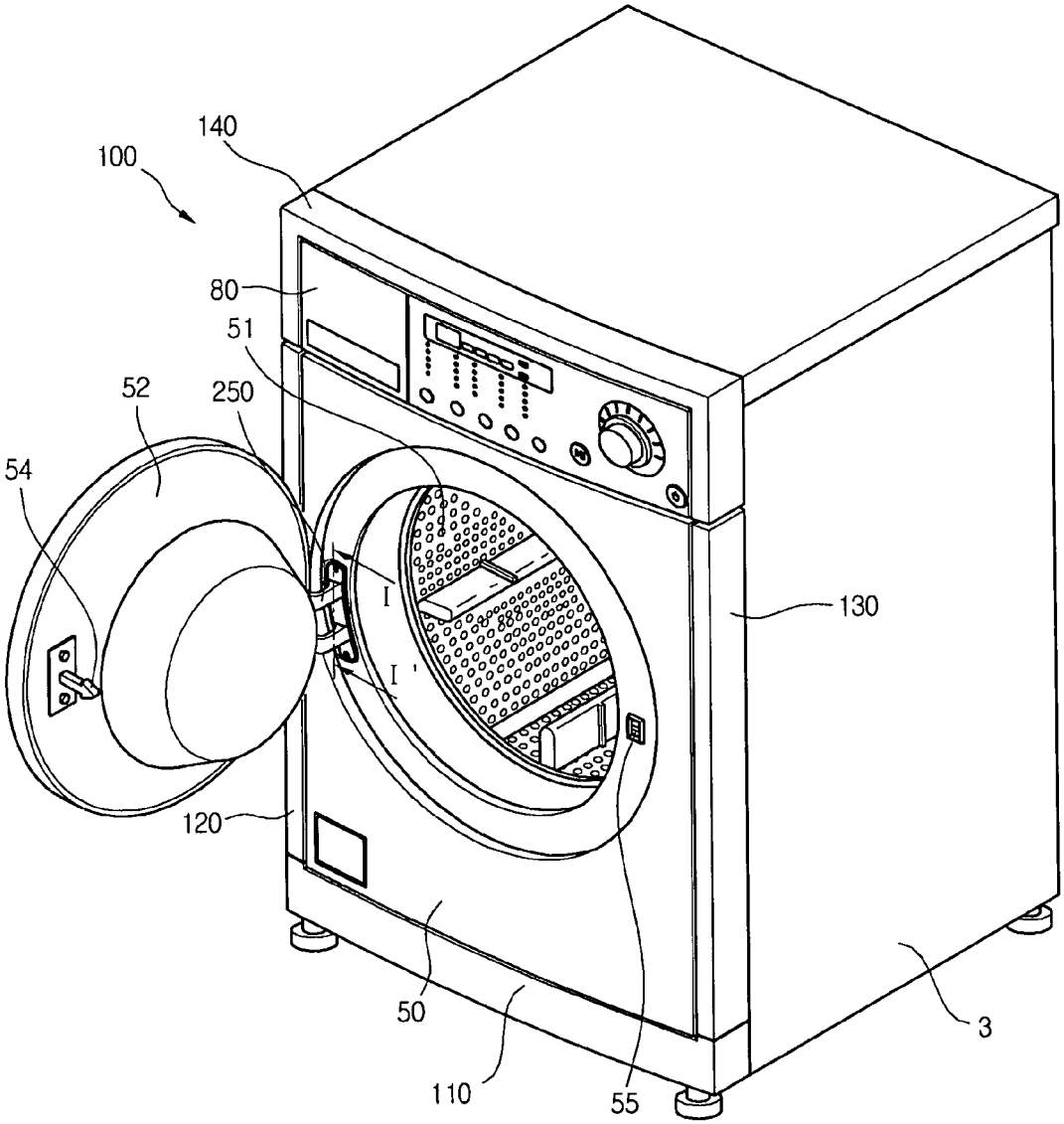
FIG. 1 is a perspective view of a washing machine according to the present invention.

FIG. 1 is a perspective view of a washing machine according to the present invention.

Referring to FIG. 1, the washing machine includes a cabinet 3 and a cabinet cover 50 attached to a front side of the cabinet 3.

The cabinet cover 50 includes a fabric opening portion 51 for putting fabrics into the washing machine and taking the fabrics out of the washing machine. A door 52 is installed on the cabinet cover 50 for opening and closing the fabric opening portion 51.

A hinge member 250 is installed between the cabinet cover 50 and the door 52 for allowing rotation of the door 52.

The door 52 includes a hook 54 protruded from a portion opposite to the hinge member 250, and the cabinet cover 50 includes a switch 55 for locking/unlocking the hook 54.

A control panel 80 is disposed above the cabinet cover 50.

An assembling rib is protruded from one of the cabinet cover 50 and the control panel 80, and an assembling hole is formed in the other of the cabinet cover 50 and the control panel 80 for receiving and holding the assembling rib, such that the control panel 80 can be installed on a top portion of the cabinet cover 50 by coupling the assembling rib and the assembling hole.

In the current embodiment of the present invention, a deco panel 100 is attached along left, bottom, right, sides of the cabinet cover 50 and left, top, and right sides of the control panel 80.

The deco panel 100 is used for protecting the cabinet 50 and the control panel 80 and increasing the frontal cosmetic appearance of the washing machine. The deco panel 100 may be provided in one piece or include a plurality of deco panel members 110, 120, 130, and 140 attached around the cabinet cover 50 and the control panel 80. Hereinafter, only the latter case will be described.

The deco panel member 110 is a bottom deco panel member disposed on the bottom side of the cabinet 50. The deco panel member 120 is a left deco panel member disposed on the left side of the cabinet cover 50. The deco panel member 130 is a right deco panel member disposed on the right side of the cabinet cover 50. The deco panel member 140 is a top deco panel member disposed along the left, top, and right sides of the control panel 80.

Figure 2:
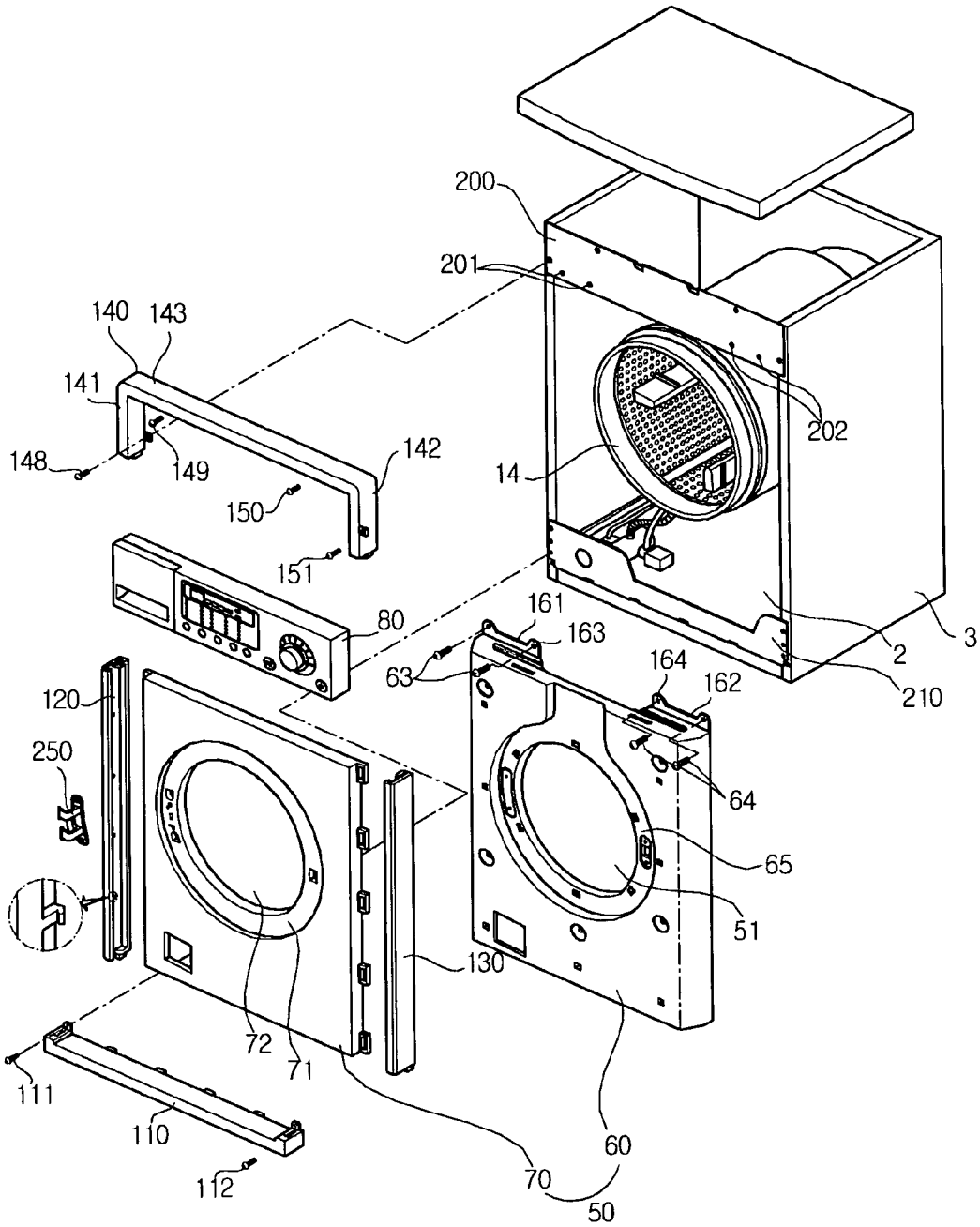
FIG. 2 is an exploded perspective view of the washing machine depicted in FIG. 1.

FIG. 2 is an exploded perspective view of the washing machine depicted in FIG. 1.

Referring to FIG. 2, the washing machine includes a front upper frame 200 installed between front upper ends of the cabinet 3, and a front lower frame 210 installed between front lower ends of the cabinet 3.

The cabinet cover 50 includes a rear cabinet cover 60 and a front cabinet cover 70. The front cabinet cover 70 covers a front side of the rear cabinet cover 60 and forms the frontal exterior of the washing machine.

The rear cabinet cover 60 is formed of metal using various methods such as press die casting. Hereinafter, the case where the rear case cover 60 is formed by the press die casting will only be referred.

Since the rear cabinet cover 60 is covered by the front cabinet cover 70 and is not exposed to the outside, coating or polishing is not required for the rear cabinet cover 60.

The rear cabinet cover 60 includes a left coupling portion 161 and right coupling portion 162 that are protruded from both sides of a top end. When assembled, the coupling portions 161 and 162 are fixed to the front upper frame 200 using coupling members 63 and 64 such as screws.

For this, the front upper frame 200 includes coupling holes 201 and 202 receiving the coupling members 63 and 64, and the left and right coupling portions 161 and 162 include coupling holes 163 and 164 corresponding to the coupling holes 201 and 202 of the front upper frame 200. Therefore, the rear cabinet cover 60 can be securely fixed to the front upper frame 200 by fitting the coupling members 63 and 64 into the coupling holes 163 and 164 of the rear cabinet cover 60, and into the coupling holes 201 and 202 of the front upper frame 200.

The rear cabinet cover 60 includes a bent portion 65 recessed in a backward direction.

The fabric opening portion 51 of the cabinet 50 is formed in the bent portion 65 of the rear cabinet 60.

The fabric opening portion 51 is curled, and a portion of a gasket 14 is fitted around the curled section of the fabric opening portion 51.

The front cabinet cover 70 is formed of plastic by injection molding.

The front cabinet cover 70 couples with the rear cabinet cover 60 to cover the front side of the rear cabinet cover 60.

The front cabinet cover 70 includes a stepped portion 71. The stepped portion 71 is inserted into the bent portion 65 of the rear cabinet cover 60 when the front cabinet cover 70 and the rear cabinet cover 60 are assembled.

When assembled, the bent portion 65 of the rear cabinet cover 60 and the stepped portion 71 of the front cabinet cover 70 are in tight contact with each other and receive the door 51 partially or entirely.

The stepped portion 71 includes an opening 72 having a size larger than the fabric opening 51.

Meanwhile, the bottom deco panel 110, as shown in FIG. 1, has a horizontally elongated shape and disposed on the bottom side of the cabinet cover 50. Referring to FIG. 2, the bottom deco panel 110 includes a left side coupled to a left side of the front lower frame 210 and a left lower end of the cabinet 3 using a coupling member 111 such as a screw, and a right side coupled to a right side of the front lower frame 210 and a right lower end of the cabinet 3 using a coupling member 112 such as a screw.

The left deco panel 120 has a vertically elongated shape and disposed on the left side of the cabinet cover 50 as shown in FIG. 1. The left deco panel 120 is hooked on at least one of the front cabinet cover 70 and the rear cabinet cover 60 as shown in FIG. 2.

The right deco panel 130 has a vertically elongated shape and disposed on the right side of the cabinet cover 50 as shown in FIG. 1. The right deco panel 120 is hooked on at least one of the front cabinet cover 70 and the rear cabinet cover 60 as shown in FIG. 2.

As shown in FIGS. 1 and 2, the top deco panel 140 includes a left portion 141 disposed on the right side of the control panel 80, a right portion 142 disposed on the right side of the control panel 80, and a top portion 143 disposed on the top side of the control panel 80.

The top deco panel 140, as shown in FIG. 2, is coupled to the front upper frame 200 using coupling members 148, 149, 150, and 151 such as screws.

Figure 3:
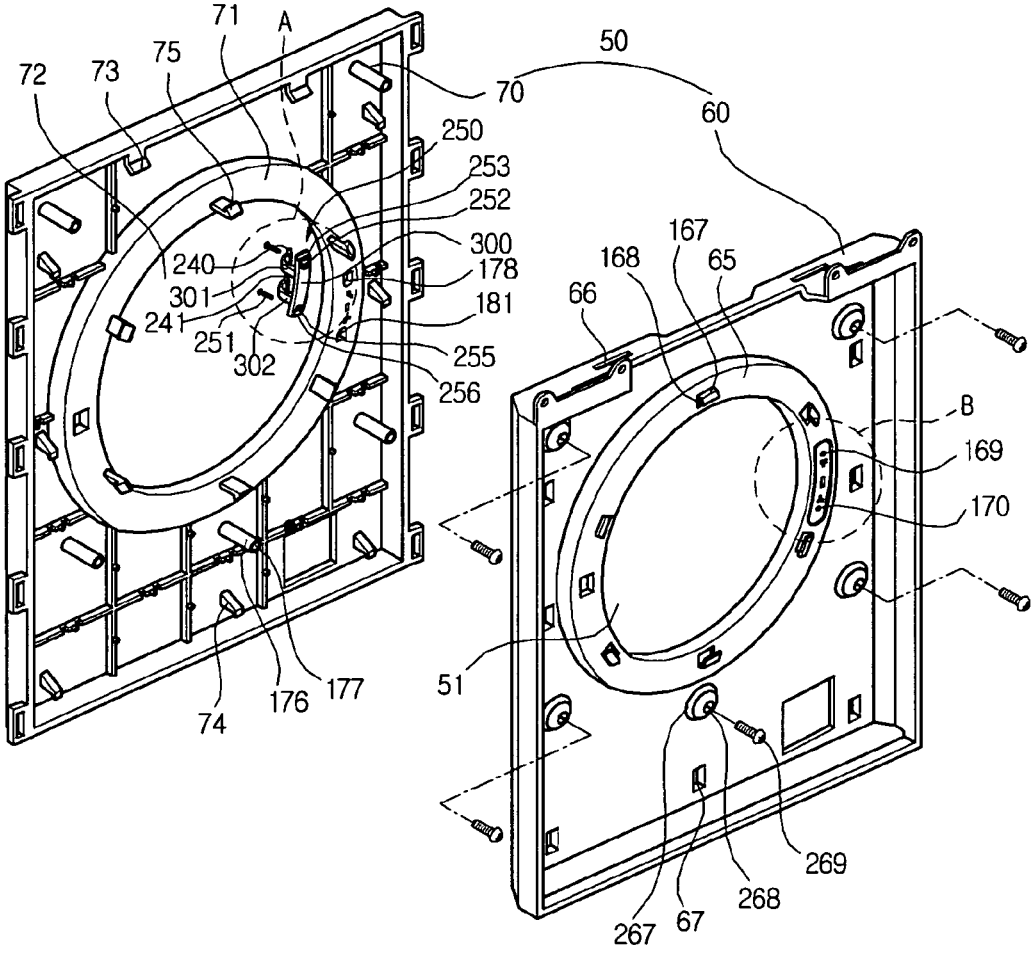
FIG. 3 is a perspective view separately showing a front cabinet cover and a rear cabinet cover that are included in the washing machine according to the present invention.
Figure 4:
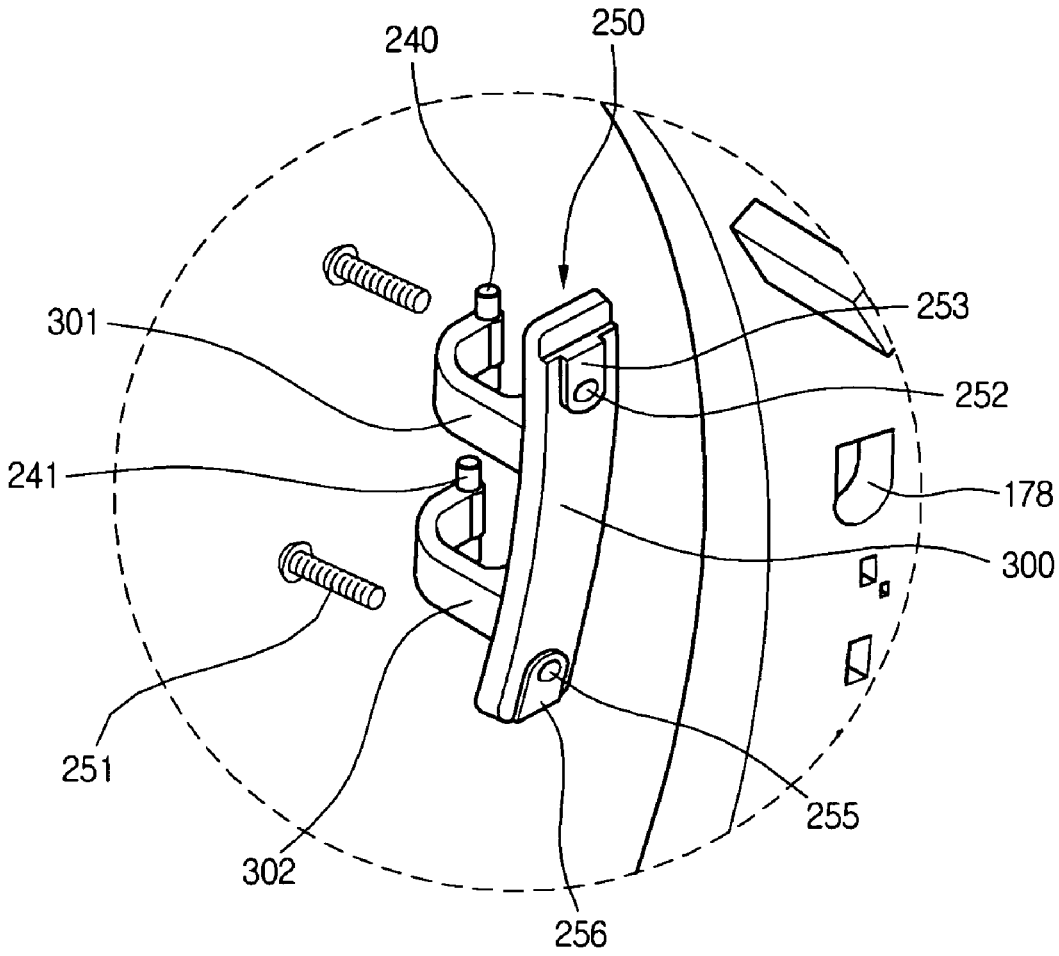
FIG. 4 is an enlarged view of portion A of FIG. 3.
Figure 5:
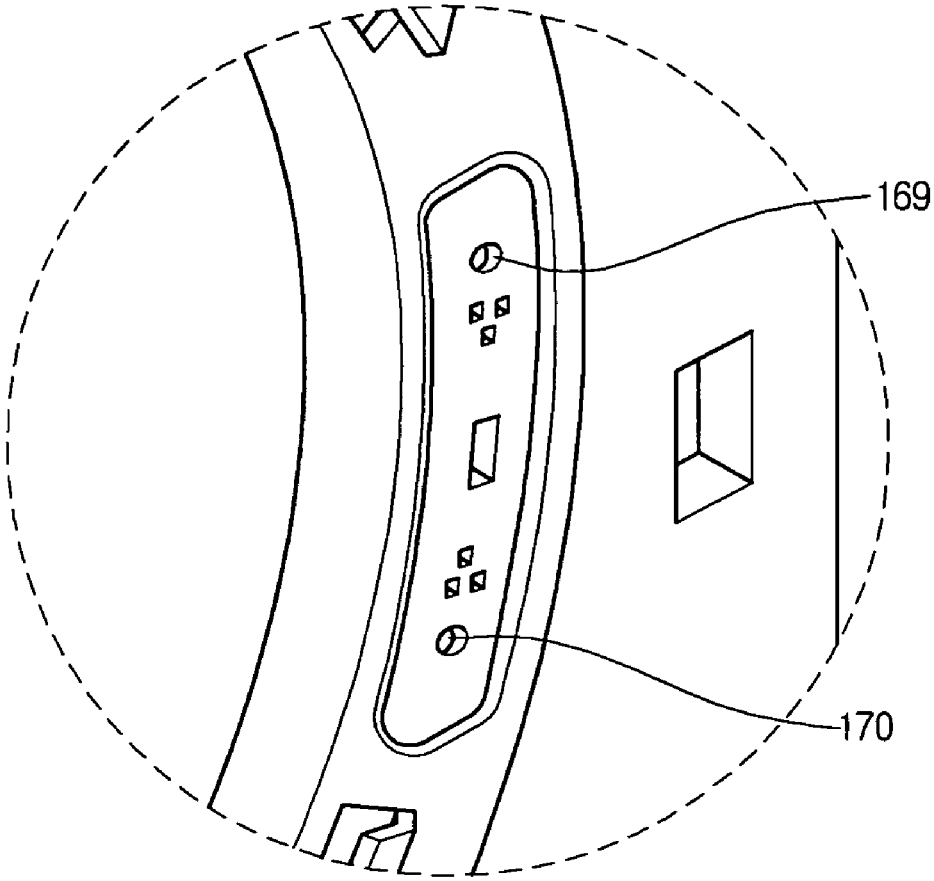
FIG. 5 is an enlarged view of portion B of FIG. 3.
Figure 6:
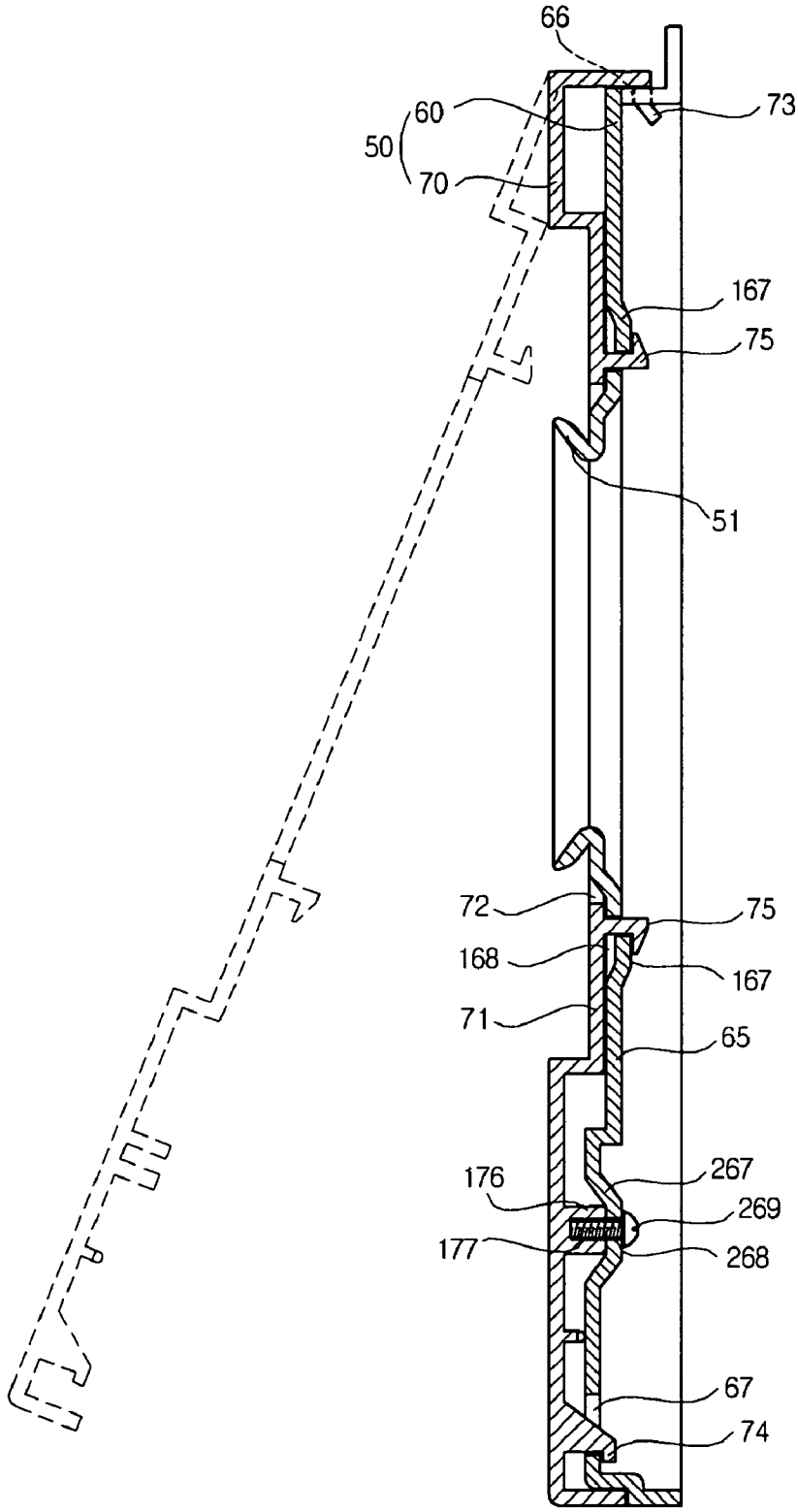
FIG. 6 is a sectional view showing assembling of the front cabinet cover and the rear cabinet cover that are included in the washing according to the present invention.

FIG. 3 is an exploded perspective view separately showing the front cabinet cover 70 and the rear cabinet cover 60 that are included in the washing machine of the present invention, FIG. 4 is an enlarged view of portion A of FIG. 3, and FIG. 5 is an enlarged view of portion B of FIG. 3, and FIG. 6 is a sectional view showing assembling of the front cabinet cover 70 and the rear cabinet cover 60.

Referring to FIGS. 3 to 6, the rear cabinet cover 60 includes rib hooking holes 66 that are vertically formed in a top surface, and the front cabinet cover 70 includes hooking ribs 73. When assembled, the hooking ribs 73 are held in the rib hooking holes 66. The front cabinet cover 70 further includes hooks 74 protruded from a rear surface, and the rear cabinet cover 60 further includes hook holes 67 that are formed in a front-to-back direction. After the hooking ribs 73 are inserted into the rib hooking holes 66, the front cabinet cover 70 is rotated on the hooking ribs 73 to insert the hooks 74 to a hooking position in the hook holes 67. In this way, the front cabinet cover 70 and the rear cabinet cover 60 can be temporarily assembled.

The front cabinet cover 70 further includes hooks 75, and the rear cabinet cover 60 includes flanges 167 formed by cutting and bending for receiving and holding the hooks 75.

The hooks 75 and the flanges 167 are formed on narrow portions of the front cabinet cover 70 and the rear cabinet cover 60 since it is difficult to use coupling members such as screws for the narrow portions. That is, the hooks 75 are formed on a rear surface of the stepped portion 71 of the front cabinet cover 70, and the flanges 167 are formed on the bent portion 65 of the rear cabinet cover 60 in correspondence with the hooks 75.

Therefore, the stepped portion 71 of the front cabinet cover 70 and the bent portion 65 of the rear cabinet cover 60 can be securely coupled to each other by inserting the hooks 75 into holes 168 formed in the bent portion 65 for the flanges 167, and by hooking the hooks 75 on the flanges 167.

The front cabinet cover 70 further includes backwardly-protruded bosses 176 each having a coupling hole 177, and the rear cabinet cover 60 includes coupling portions 267 having coupling holes 268 corresponding to the coupling holes 177. The coupling portions 267 have a backwardly projected shape formed by pressing. Therefore, the front cabinet cover 70 and the rear cabinet cover 60 can be more securely assembled by tightening coupling members 269 such as screws into the coupling holes 268 of the coupling portions 267 and the coupling holes 177 of the coupling bosses 176 from the back of the rear cabinet cover 60.

The hinge member 250 includes door coupling portions 240 and 241, a rear cabinet cover coupling portion 300, and hinge connection portions 301 and 302.

The door coupling portions 240 and 241 couples with the door 52. That is, the door 52 is rotatably fixed to the door coupling portions 240 and 241.

The rear cabinet cover coupling portion 300 of the hinge member 250 couples with the rear cabinet cover 60. The rear cabinet cover coupling portion 300 includes an upper coupling section 253 and a lower coupling section 256.

The hinge connection portions 301 and 302 connect the door coupling portions 240 and 241 with the rear cabinet cover coupling portion 300.

Figure 8:
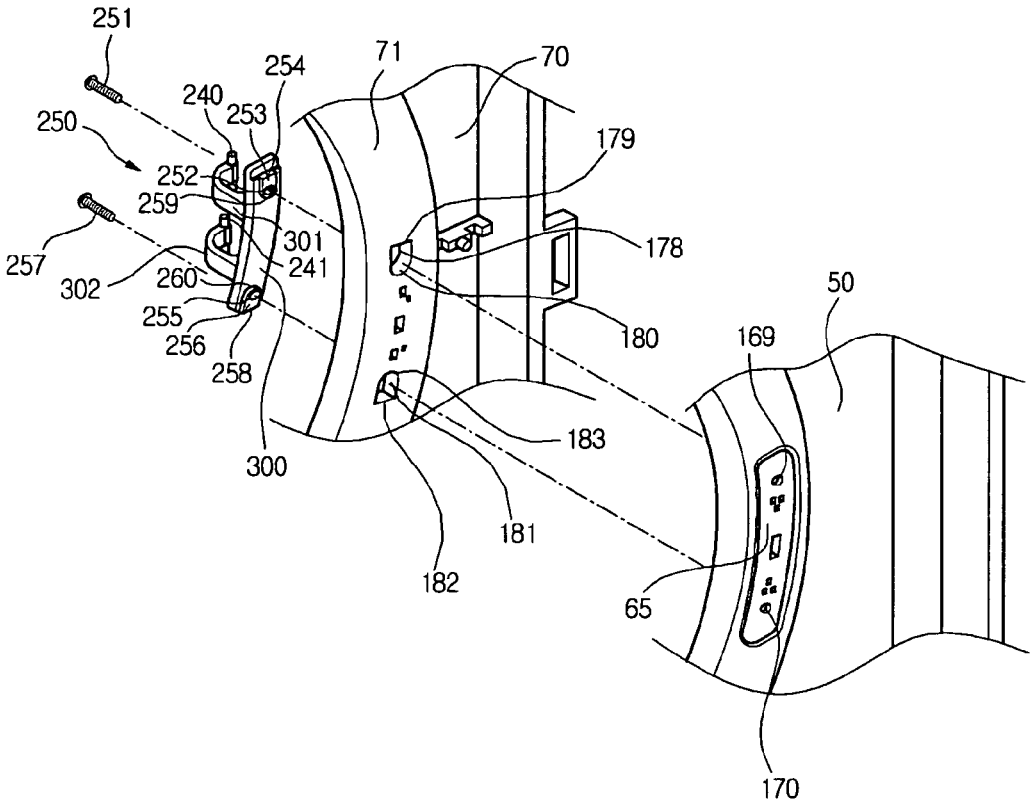
FIG. 8 is a partial perspective view showing assembling of a hinge member, the front cabinet cover, and the rear cabinet cover that are included in the washing machine according to the present invention.

The upper and lower coupling sections 253 and 256 include straight edges 254 and 258 (refer to FIG. 8) and round edges 259 and 260 (refer to FIG. 8). The straight edges 254 and 258 are formed in directions opposite to the directions of the round edges 259 and 260.

The front cabinet cover 70 includes an upper coupling section evasion hole 178 and a lower coupling section evasion hole 181. In detail, referring to FIG. 8, the upper coupling section evasion hole 178 includes a straight edge 179 corresponding to the straight edge 254 of the upper coupling section 253 and a round edge 180 corresponding to the round edge 259 of the upper coupling section 253. The lower coupling section evasion hole 181 includes a straight edge 182 corresponding to the straight edge 258 of the lower coupling section 256 and a round edge 183 corresponding to the round edge 260 of the lower coupling section 256.

The straight edges 179 and 182 are formed in directions opposite to the directions of the round edges 180 and 183.

Figure 7:
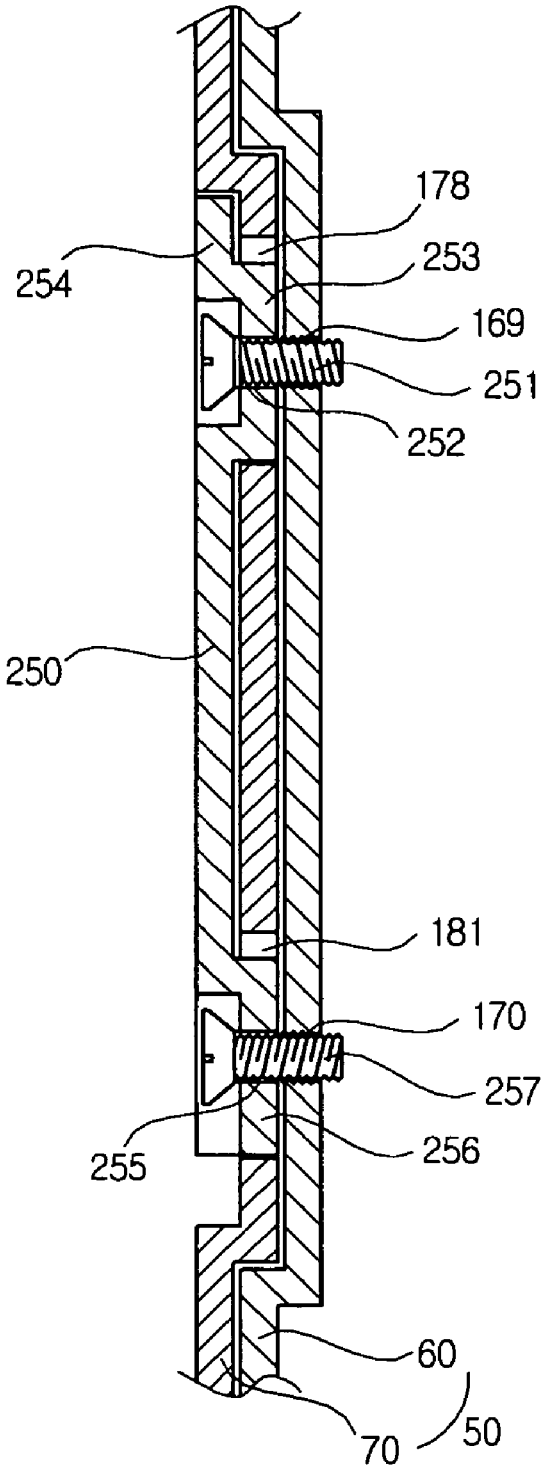
FIG. 7 is a sectional view taken along line I-I' of FIG. 1.

FIG. 7 is a sectional view taken along line I-I' of FIG. 1.

Referring to FIG. 7, the hinge member 250 can be coupled to one of the front cabinet cover 70 and the rear cabinet cover 60 using coupling members 251 and 257 such as screws.

The hinge member 250 is formed of metal.

If the hinge member 250 is coupled to the front cabinet cover 70, a gap can be occur between the hinge member 250 and the front cabinet cover 70 due to thermal deformation of the front cabinet cover 70, resulting in vibration and noise. Therefore, it is preferable that the hinge member 250 be not coupled to the front cabinet cover 70 but coupled to the rear cabinet cover 60.

The upper and lower coupling sections 253 and 256 of the hinge member 250 are backwardly protruded and include coupling holes 252 and 255 through which the coupling members 251 and 257 are inserted.

The upper and lower coupling sections 253 and 256 are recessed from a front surface of the hinge member 250 in a backward direction.

The rear cabinet cover 60 includes coupling holes 169 and 170 corresponding to the coupling holes 252 and 255 of the coupling sections 253 and 256. The coupling members 251 and 257 are tightened into the coupling holes 169 and 170.

The coupling section evasion holes 178 and 181 of the front cabinet cover 70 are larger than the coupling sections 253 and 256 of the hinge member 250 such that the coupling sections 253 and 256 can pass through the front cabinet cover 70 and then couple with the rear cabinet cover 60.

Meanwhile, in the washing machine of the current embodiment, the coupling members 251 and 257, the coupling sections 253 and 256 and the coupling holes 252 and 255, the coupling section evasion holes 178 and 181, and the coupling holes 169 and 170 of the rear cabinet cover 60 are at least two (one pair) in number, respectively. Although the numbers of these elements are not limited, descriptions of these elements are made herein based on the case where these elements are two in number, respectively.

That is, the coupling sections 253 and 256 are formed on upper and lower portions of the hinge member 250, respectively.

The coupling section evasion holes 178 and 181 are formed in upper and lower portions of the front cabinet cover 70 to receive the upper coupling section 253 and the lower coupling section 256, respectively.

The coupling holes 169 and 170 are respectively formed in upper and lower portions of the rear cabinet cover 60 in correspondence with the coupling holes 252 and 255 formed in upper and lower portions of the hinge member 250.

FIG. 8 is a partial perspective view showing assembling of the hinge member 250, the front cabinet cover 70, and the rear cabinet cover 60 that are included in the washing machine according to the present invention. The coupling procedure of the front portion of the washing machine will now be described with reference to FIG. 8.

First, the front cabinet cover 70 and the rear cabinet cover 60 are coupled to each other, and the hinge member 250 is positioned to a front side of the front cabinet cover 70.

Next, the upper and lower coupling sections 253 and 256 of the hinge member 250 are inserted through the upper and lower coupling section evasion holes 178 and 181 of the front cabinet cover 70 of the front cabinet cover 70, respectively.

When the upper coupling section 253 is inserted, the round edge 259 of the upper coupling section 253 is put on the round edge 180 of the upper coupling section evasion hole 178, and the coupling hole 252 of the upper coupling section 253 is aligned with the upper coupling hole 169 of the rear cabinet cover 60 in a front-to-back direction.

Similarly, when the lower coupling section 256 is inserted, the straight edge 258 of the lower coupling section 256 is put on the straight edge 182 of the lower coupling section evasion hole 181, and the coupling hole 255 of the lower coupling section 256 is aligned with the lower coupling hole 170 of the rear cabinet cover 60 in a front-to-back direction.

After the coupling hole 252 of the upper coupling section 253 is aligned with the upper coupling hole 169 of the rear cabinet cover 60, the coupling member 251 is inserted from the front side of the hinge member 250 into the coupling hole 252 and the coupling hole 169, such that the upper coupling section 253 can be directly fixed to the rear cabinet cover 60.

Similarly, after the coupling hole 255 of the lower coupling section 256 is aligned with the lower coupling hole 170 of the rear cabinet cover 60, the coupling member 257 is inserted from the front side of the hinge member 250 into the coupling hole 255 and the coupling hole 170, such that the lower coupling section 256 can be directly fixed to the rear cabinet cover 60.

That is, the hinge member 250 formed of metal is not coupled to the front cabinet cover 70 formed of plastic by injection molding. Instead, the hinge member 250 is directly coupled to the rear cabinet cover 60 formed of metal.

Meanwhile, the present invention is not limited to the above-described embodiments. The present invention can be applied to other devices such as a dryer and a washing machine combined with a dryer in various forms.

According to the washing machine of the present invention, since the hinge member to which the door is fixed is directly coupled to the rear cabinet cover instead of the front rear cabinet cover, the coupling between the hinge member and the rear cabinet cover can be stably maintained even when the front cabinet cover is deformed. Therefore, even when the front cabinet cover is deformed, vibration and noise are not generated.

Further, according to the washing machine of the present invention, the coupling sections of the hinge member are backwardly protruded, and the rear cabinet cover includes the coupling holes for coupling with the coupling sections of the hinge member. The front cabinet cover includes the coupling section evasion holes having a size larger than the coupling sections of the hinge member for receiving the coupling sections. Therefore, the hinge member and the rear cabinet cover can be easily coupled to each other.

Furthermore, the hinge member and the rear cabinet cover are both formed of metals, and the front cabinet cover is formed of plastic. That is, the coupling between the hinge member and the rear cabinet cover is a metal-to-metal contact coupling. Therefore, the hinge member can be more firmly coupled to the rear cabinet cover, rather than to the front cabinet cover.

In addition, since the coupling members, the coupling sections, the coupling holes of the rear cabinet cover, and the coupling section evasion holes are at least two (one pair) in number, respectively, the hinge member and the rear cabinet cover can be more stably coupled to each other.

Moreover, the coupling sections of the hinge member include straight edges and round edges, and the coupling section evasion holes of the front cabinet cover include straight edges and round edges in correspondence with the coupling sections. Therefore, the hinge member can be more easily coupled to the rear cabinet cover since the coupling sections are stably received by the coupling section evasion holes.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine comprising:

a rear cabinet cover including at least one cabinet coupling hole;

a hinge member including a door coupling portion, at least one rear cabinet cover coupling section having at least one hinge coupling hole corresponding to the at least one cabinet coupling hole, the coupling section being fixed to a front surface of the rear cabinet cover, and a connection portion extending away from the coupling section in an opposite direction from the front surface of the rear cabinet cover to connect the door coupling portion with the coupling section;

a door being rotatably coupled to the door coupling portion;

a front cabinet cover configured to be disposed in front of the rear cabinet cover and having at least one coupling section evasion hole through which the coupling section is inserted; and a coupling member coupling the hinge member with rear and front cabinet cover, wherein the door coupling portion is fixed to the rear and front cabinet cover by the coupling member and is stationary when the door is rotated with respect to the door coupling portion, and wherein the inner surface of the coupling section evasion hole is spaced apart from the outer surface of the coupling section.

2. The washing machine according to claim 1, wherein the hinge member is coupled to a front surface of the rear cabinet cover.

3. The washing machine according to claim 1, wherein each of the hinge member and rear cabinet cover is formed of a metallic material.

4. The washing machine according to claim 1, wherein the front cabinet cover is formed of a plastic.

5. The washing machine according to claim 1, wherein the front cabinet cover covers entire front surface of the rear cabinet cover.

6. A washing machine comprising:

a door;

a front cabinet cover forming a front part of the washing machine;

a rear cabinet cover disposed at a rear side of the front cabinet cover;

a hinge member connecting the door and the rear cabinet cover, the hinge member disposed in front of the front cabinet cover and including at least one coupling section configured to protrude from a face of the hinge member opposite the door;

a coupling member configured to couple the rear cabinet cover with the hinge member, the coupling member configured to be inserted into the rear cabinet cover and the coupling section;

a coupling section evasion hole formed at the front cover to evade coupling the front cover with the coupling member such that the coupling section goes through the coupling section evasion hole and is coupled to a front surface of the rear cabinet cover, wherein an inner circumference of the coupling section evasion hole is larger than an outer circumference of the coupling section by a predetermined size, and wherein the coupling member passes through the coupling section evasion hole to be coupled to the rear cabinet cover.

7. The washing machine according to claim 6, wherein the hinge member further comprises a door coupling portion coupled to the door.

8. The washing machine according to claim 6, wherein each of the rear cabinet cover and the hinge member is formed of a metallic material.

9. The washing machine according to claim 7, the coupling section is formed integrally with the hinge member.

10. The washing machine according to claim 7, wherein the coupling section comprises a straight edge and a round edge, and the coupling section evasion hole comprises a straight edge and a round edge that correspond to the straight edge and the round edge of the section.

11. The washing machine according to claim 7, wherein the coupling section comprises an upper coupling section and a lower coupling section installed on an upper part and a lower part of the hinge member, respectively.

12. The washing machine according to claim 11, wherein the coupling section evasion hole comprises two symmetrically-arranged holes through which the upper coupling section and the lower coupling section are inserted, respectively.

13. The washing machine according to claim 6, further comprising a cabinet coupling hole formed at the rear cabinet to receive the coupling member; and a coupling section formed at the hinge member, the coupling section having a hinge coupling hole to be corresponding to the cabinet coupling hole.

14. A washing machine comprising:

a hinge member including a hinge connection portion, a door coupling portion, and a rear cabinet cover coupling portion with a rear cabinet cover coupling portion coupling hole, wherein the door coupling portion is coupled to the rear cabinet cover coupling portion by the hinge connection portion;

a door coupled to the door coupling portion;

a rear cabinet cover including a rear cover coupling hole;

a front cabinet cover including a coupling portion evasion hole; and a coupling member configured to couple the rear cabinet cover with the hinge member, the coupling member configured to be inserted into the rear cabinet cover coupling hole and the rear cabinet cover coupling portion coupling hole, wherein the hinge member is stationarily fixed to the rear cabinet cover and the door rotates with respect to the hinge member, wherein an inner circumference of the coupling portion evasion hole is larger than an outer circumference of the rear cabinet cover coupling portion by a predetermined size, wherein the coupling member passes through the coupling portion evasion hole to be coupled to the rear cabinet cover, and wherein the front cover is fixedly held between the hinge and the rear cabin cover.

* * * * *